United States Patent [19]

Iacono

[11] 4,037,766

[45] July 26, 1977

[54] MULTIPLE BOTTLE CARRIER

[76] Inventor: John Q. Iacono, 1638 Jasmine Ave., New Hyde Park, N.Y. 11040

[21] Appl. No.: 663,301

[22] Filed: Mar. 3, 1976

[51] Int. Cl.[2] ..... B65D 71/00

[52] U.S. Cl. ..... 224/45 AA; 294/87.26; 206/160

[58] Field of Search ..... 224/45 AA, 45 A, 45 AC; 294/87.24, 87.26, 87.28, 87.22; 206/160, 145, 427

[56] References Cited

U.S. PATENT DOCUMENTS

| | | | |
|---|---|---|---|
| 2,337,243 | 12/1943 | Hutaff, Jr. | 294/87.26 |
| 2,395,755 | 2/1946 | Parks | 294/87.26 |
| 2,407,529 | 9/1946 | Bertram | 294/87.26 |
| 2,803,487 | 8/1957 | Dalton | 294/87.28 |
| 2,841,435 | 7/1958 | Rochon | 294/87.28 |

*Primary Examiner*—Robert J. Spar
*Assistant Examiner*—Kenneth Noland
*Attorney, Agent, or Firm*—Bauer, Amer & King

[57] ABSTRACT

A multiple bottle carrier of the bottleneck-gripping type in which the bottles are suspended from a slotted member, and an accessory is effectively utilized to cooperate in varying the effective widths of the slots of said slotted member to correspondingly adapt the carrier for different size bottles.

6 Claims, 5 Drawing Figures

MULTIPLE BOTTLE CARRIER

The present invention generally relates to a transportation device for bottles which might typically contain samples for quality control testing and thus must be protected against contamination, the carrier to this end being of the bottleneck-gripping type, and more particularly relates to an improved bottle carrier readily adapted to maintain a varying range of sizes of bottles in suspended position therein.

As generally understood, to minimize contact, and thus contamination, of bottles containing test samples, it is advantageous to transport the bottles while suspended by their bottlenecks, so that the bottles are in a desirable clearance position with respect to walls and the bottom of the carrier. Carriers of this type, or which may be used as indicated, are described in the patent literature, as exemplified by U.S. Pat. Nos. 2,140,314 and 3,884,354. These known carriers utilize the circular opening in their tops through which the neck of the bottle is projected and then engaged with a larger diameter cap to prevent reverse direction movement. While these prior art carriers effectively suspend the bottles, and thus minimize contamination, the use of the circular openings to receive bottleneck severly limits the carrier to bottles of a specific size, because of the difficulty in modifying the circular opening receiving the projected neck of the bottle.

Broadly, it is an object of the present invention to provide an improved bottle carrier overcoming the foregoing and other shortcomings of the prior art. Specifically, it is an object to achieve sanitary transportation for test sample bottles, but in a carrier that is readily adapted to handle different size bottles.

A multiple bottle carrier demonstrating objects and advantages of the present invention includes a top bottleneck-gripping member of generally rectangular shape having plural slots of a selected width therein each open at one end and oriented transversely of said member in spaced apart relation. During use, each bottle has an operative position in which its neck is projected upwardly through one of the slots and a larger diameter cap is engaged thereto to obviate reverse direction movement through the slot. The carrier further includes a closure element for the slots oriented transversely of the top member and positioned adjacent said slot end openings, and arranged for opening and closing movements relative to said slot end openings. Along the opposite edge of said top member, i.e., remote from said slot end openings, there is an upstanding grip in overhanging relation to the top member. Completing the carrier is a slot size-adjusting member having an operative superposed position on the top member with an edge thereof engaged beneath the upstanding grip, said slot size-adjusting member having slots therein adapted to assume a selected degree of misalignment relative to the slots of said top member so as to diminish the effective width thereof to the extent of said degree of misalignment. As a consequence, the carrier is adapted to be used for a range of sizes of bottles.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein.

Figure 1:
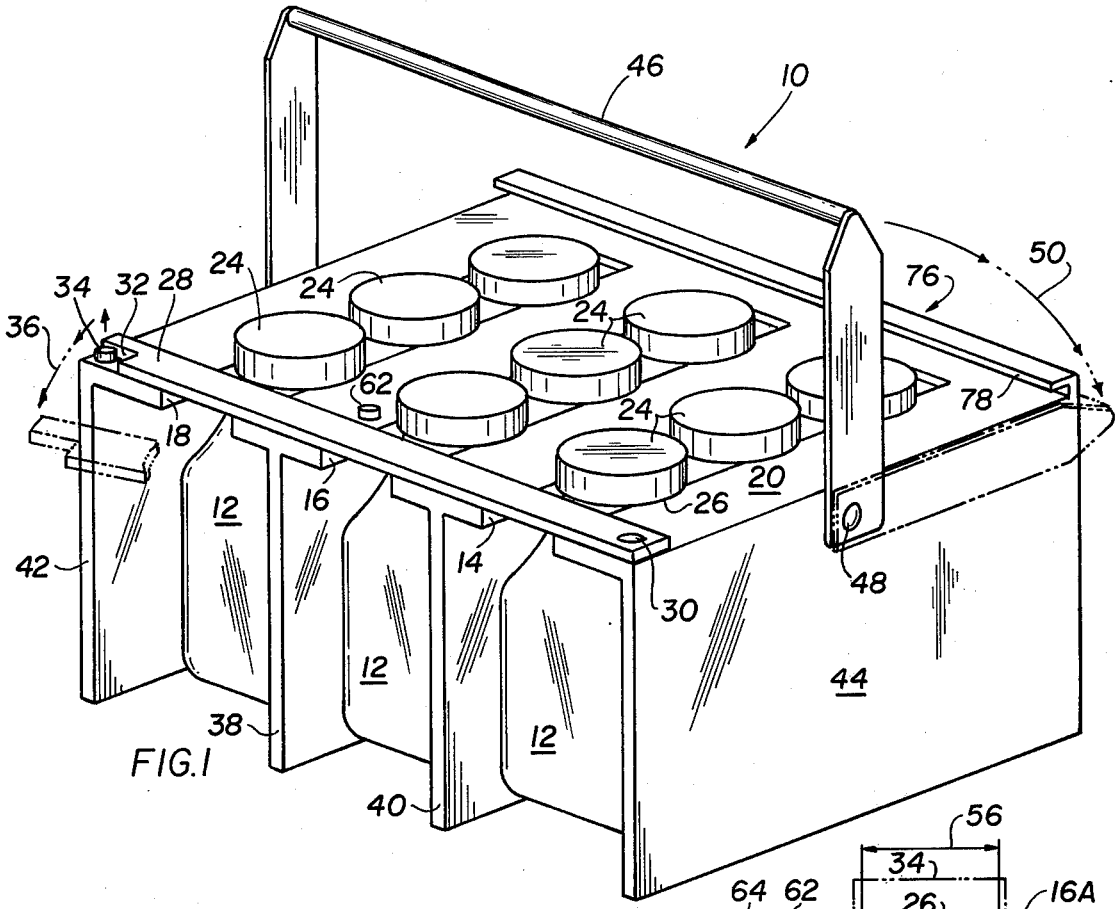
FIG. 1 is a perspective view of a multiple bottle carrier according to the present invention.

Reference is made to the drawings and in particular to FIG. 1 wherein there is shown a carrier, generally designated 10, that is advantageously used for carrying multiple bottles, individually and collectively designated 12, which, in turn, are specifically advantageously used for storing sample materials for quality control testing or the like. Although the carrier 10 is not specifically limited to this use, this use exemplifies its qualities of minimizing contamination which typically results from the use of prior art carriers in which there is a tendency for the accumulation of dust and/or the test sample itself on the interior surfaces of the carrier. Thus, carrier 10 obviates the accumulation of dust, etc. by obviating the need for a bottom to the container. In this respect, however, container 10 is not unlike prior art carriers which also rely on engagement of the bottles being transported about the neck of the bottle and beneath a larger diameter cap secured to the bottle. However, while these prior art carriers effectively suspend the bottles, and thus minimize contamination, their use of circular openings to receive the bottleneck severly limits the carrier to bottles of a specific size, because of the difficulty in modifying the circular opening receiving the projected neck of the bottle.

Figure 2:
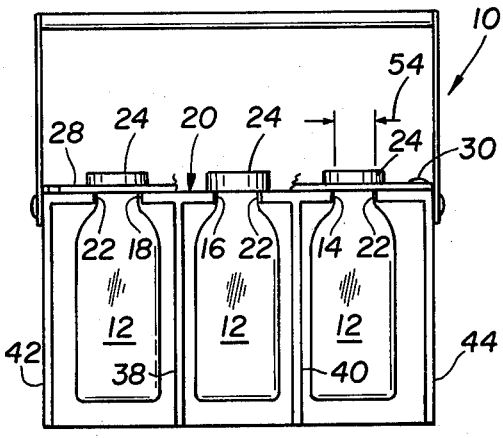
FIG. 2 is a side elevational view illustrating further structural details.

Carrier 10 overcomes the foregoing and other shortcomings of the prior art. Specifically, in the illustrated form of carrier 10 the bottles are not received in circular openings, but instead are projected upwardly through slots 14, 16 and 18 provided in spaced apart relation in a transverse orientation in a top member 20. The loading of carrier 10, and specifically the just mentioned slots of top member 20 thereof, can be accomplished in either one of two ways. It is of course to be assumed that the neck of the bottle is slightly smaller than the width of the slots 14, 16 and 18, so that the bottlenecks, individually and collectively designated 22 in FIG. 2, fit within the confines of the slots. Thus, carrier 10 is readily loaded by projecting uncapped bottle 12 upwardly through a cooperating one of the slots, and then threadably engaging a larger diameter cap 24 to the bottle which effectively maintains the bottle in its suspended position from the top member 12. In this connection, it is of course to be understood that each cap 24 is of a sufficiently larger diameter than the width of the slots 14, 16 and 18 so that there is engagement with the undersurface of each cap, as at 26 (see FIG. 1), with the edges of top member 20 which border or bound each of the slots.

The other way in which the carrier 10 may be loaded with bottles 12 is by sliding the capped bottle into the slot through the open end thereof. This method of loading naturally requires unobstructed movement through the end openings of the slots 14, 16 and 18. Normally, however, these slot end openings are closed by a flexible closure element 28 appropriately bolted or otherwise connected at one end, as at 30, to the top member 20. At its other end, element 28 is provided with a notch 32 which effectively latches or holds it in place relative to an upstanding stop projection 34. The length of element 28 and its flexurable material of construction, such as plexiglass or other plastic material, is such as to permit flexuring in the unconnected end of the element which provides the degree of opening and closing movements, designated 36 and illustrated in full line and phantom perspective in FIG. 1, relative to the slot end openings 14, 16 and 18.

To prevent contact of the vertically suspended bottles 12 with any support surface, connected in depending relation from the underside of top member 12 are dividing walls 38, 40 and opposite end walls 42 and 44. So as not to obscure or mask the identifying labels that might be adhesively secured to the bottles 12, a preferred construction material for the walls 38, 40, 42 and 44, as well as for the top 20 is transparent plexiglass or some other appropriate transparent material.

Contributing to the ease of transporting the carrier 10 is a carrying handle 46 pivotally connected at its opposite ends, as at 48, to the opposite side walls 42 and 44 of the carrier. The normal position for the handle 46 is one in which it stands upright in a central plane oriented transversely of the top member 20, thus strategically locating the handle 46 at the center of balance of the carrier 10. The pivotal connections 48 at opposite ends of the handle provide it with pivotal movement 50 when not in use into a storage position illustrated in phantom perspective in FIG. 1.

Figure 5:
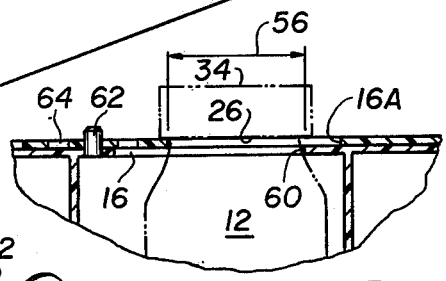
FIG. 5 is a sectional view, taken on line 5—5 of FIG. 3, showing further structural details.
Figure 4:
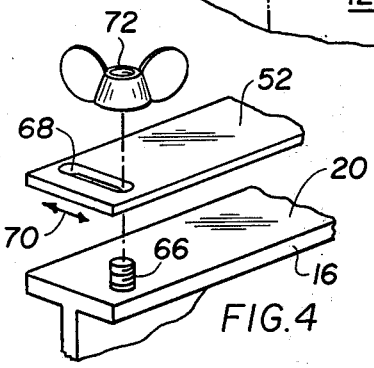
FIG. 4 is a partial perspective view illustrating an alternative method of connecting said attachment of FIG. 3 to the carrier.
Figure 3:
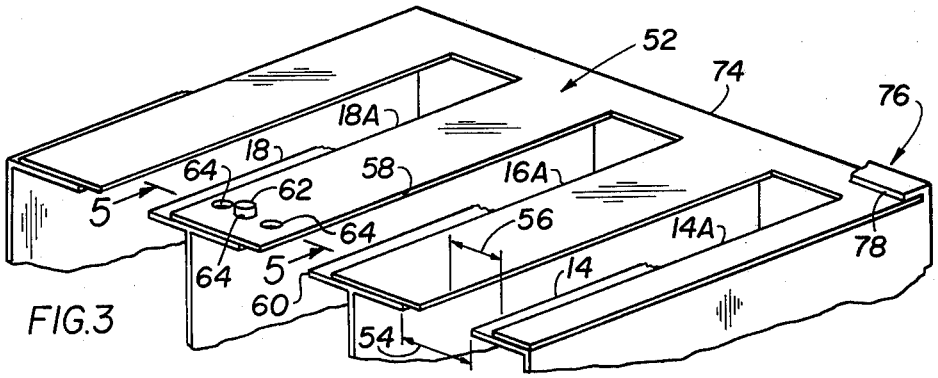
FIG. 3 is a partial perspective view illustrating use of an attachment for said carrier which enables it to handle a range of different sizes of bottles.

Reference should now be made to FIGS. 3, 4 and 5 which illustrate an essential component of the carrier 10, namely a slot size-adjusting member, generally designated 52. Member 52, like top member 20, is provided with three slots 14A, 16A and 18A, each of which, as is suggested by the numerical designation, is associated respectively with the slots 14, 16 and 18. The cooperative association results from member 52 in use assuming a superposed position on the top member 20 in which the respective slots can assume aligned positions with each other, but to achieve a useful function, are purposely arranged in a selected misaligned relation. More particularly, as illustrated in FIG. 3 and also in cross-section in FIG. 5, depending upon the degree of misalignment between slots 16 and 16A, for example, the effective width of slot 16 for purposes of providing supporting edges for the overhang 26 of each cap 34 is correspondingly diminished. Thus, while the original effective width of the slots 14, 16 and 18 is a selected size designated 54 in FIG. 2, a smaller size for a correspondingly smaller necked bottle 12 is obtained by misalignment of slot 16A relative to slot 16. More particularly, the effective size 56 is reduced to a size bounded on the left, as viewed in FIG. 5, by the edge 58 (see FIG. 3) of member 53 which bounds slot 16A and, on the right side, by edge 60 of top member 20 which bounds slot 16. There is no significant adverse effect due to the difference in elevations of the top member 20 and size-adjusting member 52 because of the optimum minimum thickness of member 52. In this respect, since top member 20 remains in a supporting position beneath the member 52, said member 20 effectively carries the brunt of the weight of the bottles 12 and their contents.

Several alternative ways have proven effective in maintaining the selected superposed position of member 52 on the top member 20. One way, as illustrated in FIG. 3, consists of providing an upstanding projection 62 in the member 20 which, in practice, projects through any one of three openings 64 in the size-adjusting member 52. Alternatively, as illustrated in FIG. 4, projection 62 may be formed of metal and threaded, as illustrated at 66, and adapted to be projected through an oval slot 68 oriented in the direction of adjusting movement 70 of member 52, the projecting end of the threaded element 66 being threadably engaged by a wing nut 72.

To effectively confine the other edge 74 of member 52 in place, the rear wall of the carrier 10 has an upstanding grip construction 76 therealong which includes a leg 78 which overhangs the upper surface of top member 20. As clearly illustrated in FIG. 3, edge 74 is projected beneath, and has sliding movement within, the construction 76.

From the foregoing description it should be readily recognized that carrier 10 is characterized by a simple construction which nevertheless has a capacity for transporting a plurality of bottles, each effectively suspended in the carrier so as to minimize contamination. Further, an important aspect of carrier 10 is the cooperative relation between the member 52 and its top 20 in which selected misalignment therebetween enhances the end uses of carrier 10 by enabling it to accommodate a range of different size bottles.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A multiple bottle carrier comprising a top bottleneck-gripping member of generally rectangular shape having plural slots of a selected width therein each open at one end and oriented transversely of said member in spaced apart relation to accommodate bottles each having an operative position in said carrier in which the neck of a bottle is projected upwardly through one said slot and a larger diameter cap is engaged to the bottleneck to obviate reverse direction movement through said slot, a closure element for said slots oriented transversely of said top member adjacent said slot end openings and arranged for opening and closing movements relative to said slot end openings, an upstanding grip along said top member remote from said slot end openings in overhanging relation to said top member, a slot size-adjusting member having an operative superposed relationship with said top member with an edge thereof engaged beneath said upstanding grip, said slot size-adjusting member having slots therein each open at the same one end thereof as said slots of said top member to receive bottles through said open ends and adapted to assume a selected degree of misalignment relative to said slots of said top member so as to diminish the effective width of said slots of said top member to the extent of said degree of misalignment, whereby said slots of said carrier are adapted to be used for a range of sizes of bottles, and means depending from said top member to support bottles held in the carrier free of contact with a support surface.

2. A multiple bottle carrier as defined in claim 1 wherein said top member is sized to have at least three spaced apart slots therein and said closure element is of a corresponding size and of a springy construction material, whereby said size and springy construction material of said closure element enables the flexuring thereof to provide said opening and closing movements relative to said slot end openings.

3. A multiple bottle carrier as defined in claim 2 including a carrying handle connected to extend along a medial plane transverse to said slots of said top member, whereby said handle is substantially at the center of balance of said carrier.

4. A multiple bottle carrier comprising a top bottleneck-gripping member of generally rectangular shape having plural slots of a selected width therein each open at one end and oriented transversely of said member in spaced apart relation to accommodate bottles each having an operative position in said carrier in which the neck of a bottle is projected upwardly through one said slot and a larger diameter cap is engaged to the bottleneck to obviate reverse direction movement through said slot, a closure element for said slots oriented transversely of said top member adjacent said slot end openings and arranged for opening and closing movements relative to said slot end openings, an upstanding grip along said top member remote from said slot end openings in overhanging relation to said top member, and a slot size-adjusting member having an operative superposed position on said top member with an edge thereof engaged beneath said upstanding grip, said slot size-adjusting member having slots therein adapted to assume a selected degree of misalignment relative to said slots of said top member so as to diminish the effective width thereof to the extent of said degree of misalignment, whereby said carrier is adapted to be used for a range of sizes of bottles, said top member is sized to have at least three spaced apart slots therein and said closure element is of a corresponding size and of a springy construction material, whereby said size and springy construction material of said closure element enables the flexuring thereof to provide said opening and closing movements relative to said slot end openings, a carrying handle connected to extend along a medial plane transverse to said slots of said top member, whereby said handle is substantially at the center of balance of said carrier, walls connected in depending relation from said top member so as to extend from between and below said bottles, whereby said carrier is supportable on a support surface along the bottom edges of said walls with said bottles held in a clearance position from said support surface.

5. A multiple bottle carrier as defined in claim 4 wherein said carrying handle is pivotally connected to said two walls serving as the opposite sides of said carrier, whereby said handle is pivotally movable into and out-of-the-way storage position when not in use.

6. A multiple bottle carrier as defined in claim 5 wherein said construction material for said depending walls is transparent, such that said bottles are not masked from view.

* * * * *